United States Patent [19]

Burnham et al.

[11] 4,099,553

[45] Jul. 11, 1978

[54] VARIABLE AIR VOLUME SYSTEM

[75] Inventors: Roger R. Burnham; Merlin K. Chapin; David A. Cook; Theodore C. Gilles, all of Marshalltown; Billy L. Williams, Montour, all of Iowa

[73] Assignee: Lennox Industries, Inc., Marshalltown, Iowa

[21] Appl. No.: 767,955

[22] Filed: Feb. 11, 1977

[51] Int. Cl.[2] ..... F24F 3/00

[52] U.S. Cl. ..... 165/22; 165/31; 165/34; 165/101

[58] Field of Search ..... 165/34, 35, 36, 37, 165/38, 103, 101, 100, 16, 22

[56] References Cited

U.S. PATENT DOCUMENTS

| | | | |
|---|---|---|---|
| 3,911,953 | 10/1975 | Crombie | 165/103 X |
| 3,927,713 | 12/1975 | Gilles | 165/16 |
| 3,982,583 | 9/1976 | Shavit | 165/16 |
| 3,994,335 | 11/1976 | Perkins | 165/35 |

*Primary Examiner*—Charles J. Myhre
*Assistant Examiner*—Margaret A. LaTulip
*Attorney, Agent, or Firm*—Allegretti, Newitt, Witcoff & McAndrews

[57] ABSTRACT

A variable air volume system for processing an enclosure is shown and described. The system includes an improved damper assembly, having independently operated damper elements, and an air mover control responsive to the damper assembly.

12 Claims, 4 Drawing Figures

VARIABLE AIR VOLUME SYSTEM

BACKGROUND OF THE INVENTION

Energy shortages have precipitated research and development of more and more efficient systems for processing and conditioning the air in an enclosure. Initially, systems having the capability to service multiple thermal zones replaced systems wherein each zone was conditioned by a separate heating, ventilating and air conditioning unit (hereinafter HVAC unit). One widely accepted multizone system (hereinafter the Gilles system) is fully described in U.S. Pat. No. 3,927,713, and its teachings are incorporated herein by reference. The present case and U.S. Pat. No. 3,927,713 have a common assignee.

The Gilles system is a constant air volume system. That is, the air mover delivers processed supply air to each zone at a constant rate, e.g., 2000 cfm.

The coldest and hottest zones receive supply air primarily from the hot and cold decks, respectively, of the HVAC unit. The zones of intermediate temperatures receive a combination of hot and cold deck supply air, effected by dampers responsive to a thermostat within the particular zone. The dampers are rigidly secured together in a perpendicular arrangement.

Multizone variable air volume systems (hereinafter VAV systems) were developed to overcome the inherent shortcomings of the constant air volume multizone systems, including the Gilles system. In particular, the VAV systems avoid, under certain conditions, the mixing of hot and cold deck supply air to process the intermediate zones. This mixing is wasteful and avoidance thereof provides the potential for substantial energy savings.

Unfortunately, the presently available VAV systems have certain disadvantages not found in the Gilles system. The VAV systems do not have heat reclaim capability, without expensive additional equipment; morning warmup, particularly after weekend shutdown periods, is slow and inefficient; under certain operating conditions, supply air must be substantially cut off to avoid reheat characteristics, virtually eliminating fresh air ventilation of the zone; and further, separate perimeter zone heating units are often required.

SUMMARY OF THE INVENTION

The present invention is primarily an improved VAV system substantially overcoming the disadvantages experienced with presently available VAV systems. The present invention effectively converts the Gilles system into a VAV system, thereby combining the respective advantages.

In a principal aspect, the present invention includes an improved damper assembly and an operational control for the air mover of the Gilles system. The improved damper assembly includes a shaft and a tube, rotatably mounted on the supply air duct, i.e., the duct communicating with the hot deck and the cold deck of the HVAC unit. A damper element is secured to the shaft and the tube. Each damper element is adapted to close one deck passage in the supply air duct.

The shaft and the tube include actuating arms, external of the supply air duct, rotated by a drive assembly to properly position the damper elements. The drive assembly, responsive to a thermostat within the zone, has drive arms for engagement with the actuating arms. The drive arms are detachably securable to the actuating arms to positionally maintain the damper elements against the flow of supply air.

The damper assembly also includes damper stops. The stops detachably secure or maintain the damper elements in a predetermined damper position.

The operational control varies the output of the air mover in response to the damper assembly, thereby providing air volume control. With throttling by the damper assembly, the output is appropriately decreased.

It is thus an object of the present invention to provide an improved VAV system. Another object is to provide a VAV system, having the desirable operable characteristics of a multizone constant air volume system, i.e., the Gilles system.

Still another object of the present invention is to provide an improved damper assembly for a VAV system. It is also an object to provide an improved damper assembly and an air mover control responsive thereto.

A further object is to provide a more efficient VAV system, thereby reducing energy costs. Yet another object of the present invention is a readily manufactured, inexpensive VAV system.

These and other objects, features and advantages of the present invention are discussed and suggested in the following detailed description of a preferred embodiment.

DESCRIPTION OF THE DRAWING

A preferred embodiment of the present invention is described, in detail, with reference to the drawing wherein.

DESCRIPTION OF THE PREFERRED EMBODIMENT

Figure 1:
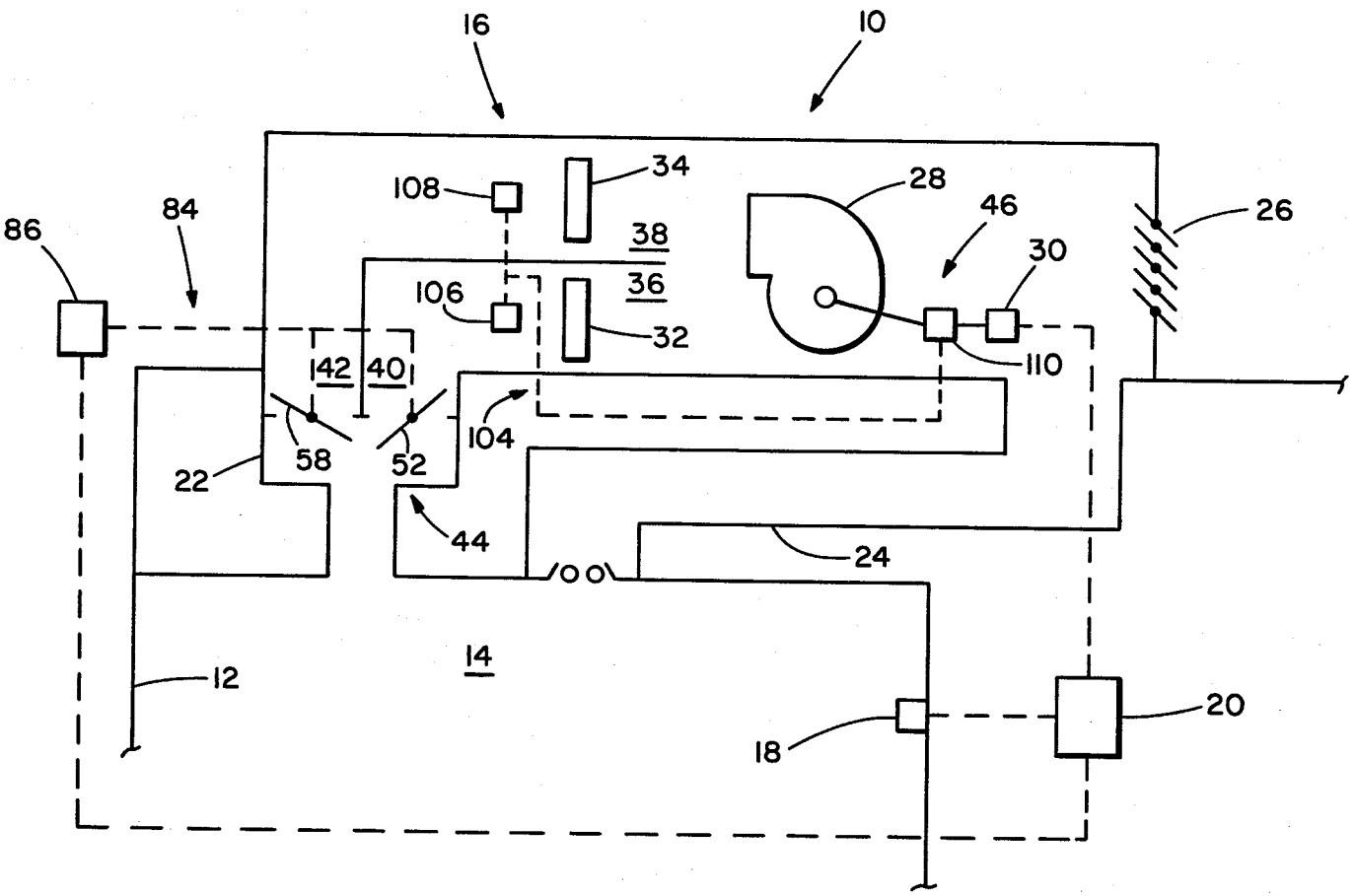
FIG. 1 is a schematic diagram illustrating a preferred embodiment of the present invention as incorporated into the Gilles system.

Referring to FIG. 1, a preferred embodiment of the present invention is shown as incorporated into a Gilles system, generally designated 10. For clarity, only a simplified Gilles system 10 is shown; however, it is to be understood that the present invention is operable with the full and complete Gilles system, shown in U.S. Pat. No. 3,927,713. Further, it is to be understood that the present invention is equally applicable to a single zone air processing system.

The Gilles system 10 processes the air in an enclosure 12 having a series of thermal zones 14. Again, for clarity, only a single thermal zone 14 is shown in FIG. 1.

The Gilles system 10 basically includes a HVAC unit, generally designated 16, thermostatic means 18 for sensing the air temperature in the zone 14, a control mechanism 20, a supply air duct 22 and a return air duct 24. Fresh air for ventilation is provided through an outdoor damper 26.

As shown, the HVAC unit 16 includes an air mover 28, driven by a motor 30, an air heater 32 and an air cooler 34. The air heater 32 and the air cooler 34, respectively, define a first or hot deck 36 and a second or cold deck 38 within the HVAC unit 16.

The supply air duct 22 interconnects the enclosure 12, or zone 14, and the air mover 28. The supply air duct 22 includes a first passage 40 and a second passage 42 communicating with the hot deck 36 and the cold deck 38, respectively.

The preferred embodiment of the present invention, shown in FIGS. 1–4, includes a damper assembly, generally designated 44, and volume control means, generally designated 46, for variably operating the air mover 28 in response to the damper assembly 44. The present invention converts the Gilles system 10 from a constant air volume system to an improved VAV system.

Figure 2:
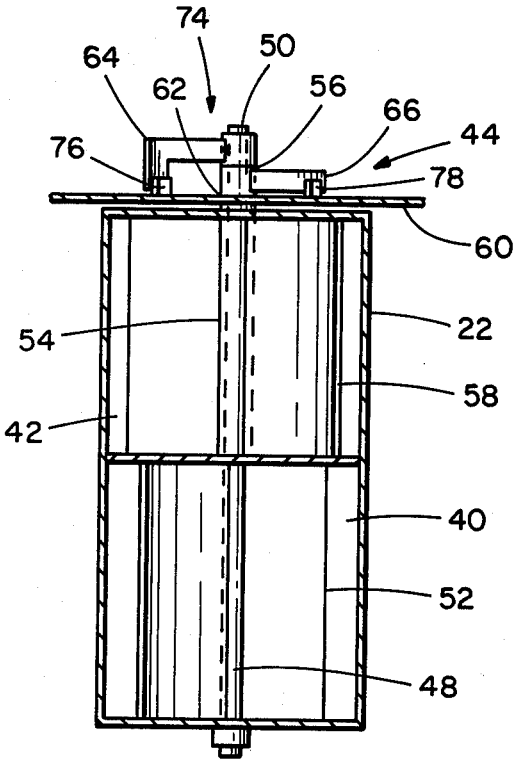
FIG. 2 is a partial cross-sectional view of the damper assembly shown in FIG. 1.
Figure 3:
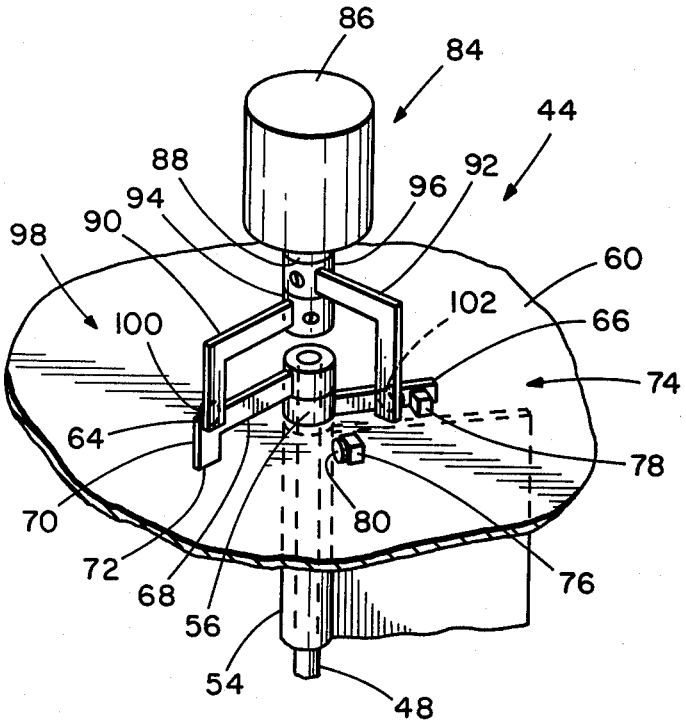
FIG. 3 is a partial perspective view of the damper assembly shown in FIG. 2.
Figure 4:
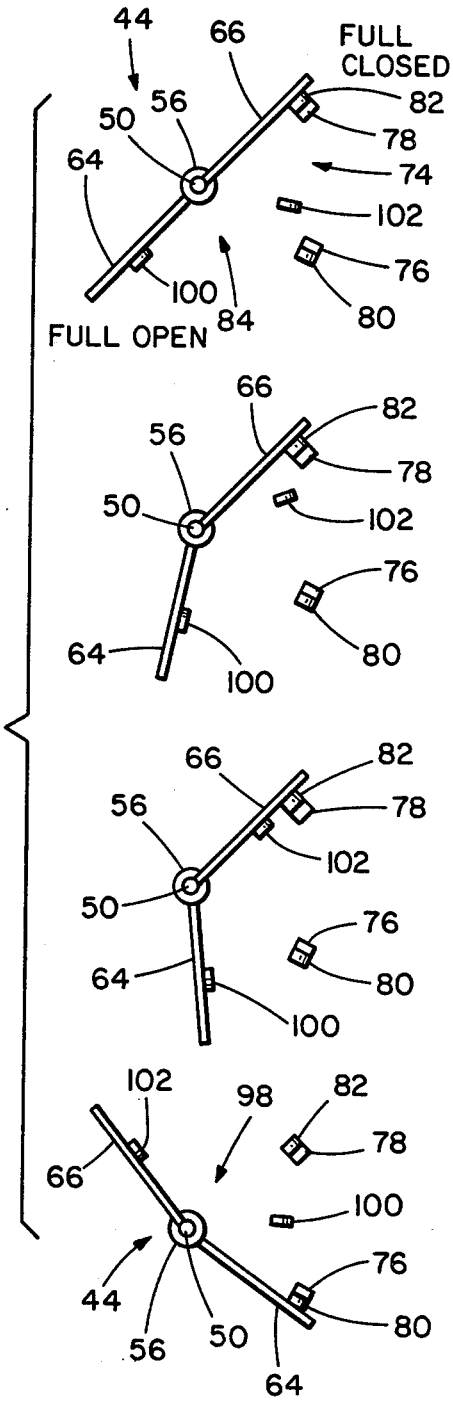
FIG. 4 is a partial top view of the damper assembly shown in FIG. 2.

Referring particularly to FIGS. 2–4, the damper assembly 44 includes a shaft 48 rotatably mounted on the supply air duct 22. The rod-shaped shaft 48 extends substantially through the first passage 40 and the second passage 42 and beyond the supply air duct 22, thereby defining a shaft control portion 50 external to the supply air duct 22.

A first damper element 52 is rigidly secured to the shaft 48 within the first passage 40 of the supply air duct 22. Rotation of the shaft 48 and the first damper element 52 opens and closes the first passage 40.

The damper assembly 44 also includes a tube 54, receiving the shaft 48. The tube 54 is rotatably mounted to the supply air duct 22 on the shaft 48.

The tube 54 extends substantially through the second passage 42 and beyond the supply air duct 22 to define a tube control portion 56. A second damper element 58 is secured to the tube 54 within the second passage 42 and variably throttles the flow of air therethrough.

As shown, the shaft 48 and the tube 54, or more particularly the shaft control portion 50 and tube control portion 56, pass through a control deck 60 in the HVAC unit 16. The substantially planar control deck 60 has an opening 62 adapted to receive the shaft 48 and tube 54.

The shaft 48 and the tube 54 include a shaft actuating arm 64 and tube actuating arm 66, respectively. The shaft actuating arm 64 and tube actuating arm 66 are rigidly connected to the shaft control portion 50 and tube control portion 56.

The tube actuating arm 66 extends substantially perpendicular to the tube control portion 56 and substantially adjacent the control deck 60. As the extension of the shaft 48 beyond the supply air duct 22 and the control deck 60 is greater than the extension of the tube 54, the shaft actuating arm 64 includes a connecting portion 68 and actuating portion 70, having an end 72. The actuating portion 70 extends substantially parallel to the shaft 48 towards the control deck 60, such that the end 72 is substantially adjacent the control deck 60.

The damper assembly further includes stop means, generally designated 74, for detachably securing the shaft 48 and the tube 54 in a first shaft position and a first tube position, respectively. Whenever the shaft 48 and the tube 54 are secured, the first damper element 52 and the second damper element 58 are positionally maintained against the flow of supply air in the supply air duct 22.

In this preferred embodiment of the present invention, the stop means 74 includes a first damper stop 76 and a second damper stop 78, secured to the control deck 60. The first damper stop 76 and the second damper stop 78 are adapted to engage the shaft actuating arm 64 and the tube actuating arm 66, respectively, and arrest movement or rotation thereof in a given direction.

The first damper stop 76 and the second damper stop 78 include a first damper magnet 80 and a second damper magnet 82, respectively. The first permanent magnet 80 and the second permanent magnet 82 detachably secured the shaft actuating arm 64 and the tube actuating arm 66 to the first damper stop 76 and the second damper stop 78, during engagement thereof.

It is to be understood that the stop means 74, described herein, is preferred, but alternatives exist. For example, permanent magnet stops could be secured with the first passage 40 and the second passage 42 of the supply duct 22. These permanent magnet stops would engage and detachably secure the first damper element 52 and second damper element 58.

The shaft 48 is operable between the first shaft position and a second opposing shaft position; similarly, the tube 54 is operable between the first tube position and a second opposing tube position. In the first shaft position and the first tube position, the first passage 40 and the second passage 42 are preferably substantially closed. The first passage 40 and the second passage 42 are substantially open whenever the shaft 48 and the tube 54 are in the second opposing shaft position and the second opposing tube position, respectively.

The damper assembly 44 further includes drive means, generally designated 84, for driving the first damper element 52 and the second damper element 58 in response to the thermostatic means 18. The drive means 84 includes a motor 86, having an output shaft 88, a shaft drive arm 90 and a tube drive arm 92.

The motor 86 of the Gilles system 10 shown in U.S. Pat. No. 3,927,713 provides an angular displacement of approximately (90°). The motor 86 of the present invention provides an angular displacement of approximately (180°), as more fully described hereinafter.

The shaft drive arm 90 and the tube drive arm 92 are adjustably mounted on the output shaft 88. The shaft drive arm 90 and the tube drive arm 92 include a shaft drive arm collar 94 and a tube drive arm collar 96, respectively, adapted to receive the output shaft 88. The shaft drive arm 90 and the tube drive arm 92 extend substantially parallel to the shaft 48, and the shaft drive arm 90 terminates a distance from control deck 60. The tube drive arm 92 terminates substantially adjacent the control deck.

The shaft drive arm 90 and the tube drive arm 92 are adapted to engage the shaft actuating arm 64 and the tube actuating arm 66, respectively. As shown, the shaft drive arm 90 is vertically displaced with respect to the first damper stop 76, and the tube drive arm 92 is radially displaced from the second damper stop 78 with respect to the shaft 48. The shaft drive arm 90 and the tube drive arm 92 interpose the shaft actuating arm 64 and the tube actuating arm 66.

The shaft 48, the tube 54 and the drive means 84 cooperatively define attachment means, generally designated 98, for detachably securing the shaft actuating arm 64 and the tube actuating arm 66 to the shaft drive arm 90 and the tube drive arm 92, respectively. Attachment or detachable securing of the shaft actuating arm 64 and the tube actuating arm 66 positionally maintains the first damper element 52 and the second damper element 58 against the air flow provided by the air mover 28.

In this preferred embodiment, the attachment means 98 includes a first drive magnet 100 and a second drive magnet 102, mounted upon the shaft drive arm 90 and the tube drive arm 92, respectively. The first damper magnet 80, the second damper magnet 82, the first drive magnet 100 and the second drive magnet 102 are preferably permanent magnets.

With particular reference to FIG. 4, the shaft 48 and the tube 54 are operable in three modes. In the first mode, the shaft 48 is in driving engagement with the drive means 84 and the tube 54 is secured in the first tube position by the stop means 74. That is, the shaft actuating arm 64 is detachably secured to the shaft drive arm 90 and the tube actuating arm 66 is detachably secured to the second damper stop 78. For clarity, the first drive magnet 100 and the second drive magnet 102 are both shown as displaced radially with respect to the first damper stop 76 and the second damper stop 78.

The drive means 84 moves the shaft 48 away from the second opposing shaft position to a first predetermined position, between the first shaft position and the second opposing shaft position, before engagement of the tube actuating arm 66 and the tube drive arm 92. Once past the first predetermined position, the shaft 48 and the tube 54 are operable in the second mode. Therein, the shaft actuating arm 64 and the tube actuating arm 66 are detachably secured to the shaft drive arm 90 and the tube drive arm 92, respectively.

Whenever the shaft 48 is secured in the first shaft position by the stop means 74, the shaft 48 and the tube 56 are operable in the third mode. Third mode operation occurs whenever the tube 54 passes a second predetermined position, moving towards the second opposing tube position. Conversely, second mode operation is initiated whenever the tube 54 passes the second predetermined position, moving towards the first tube position.

Operation of the damper assembly 44 varies the amount of supply air received by the zone 14. The throttling effect of the damper assembly 44 causes static pressure fluctuations in the hot deck 36 and the cold deck 38 of the HVAC unit 16.

In this preferred embodiment of the present invention, the volume control means 46 is responsive to the changes in static pressure within the HVAC unit 16. The volume control means 46 includes pressure means, generally designated 104, for sensing static pressure. The pressure means 104 has a predetermined set point, e.g., 0.7 inch $H_2O$.

A suitable pressure means 104 is presently manufactured and sold by Dwyer Instruments, Inc., Michigan City, Ind., as a static pressure regulator controller. The pressure means 104 includes a first sensing element 106 and a second sensing element 108 secured within the hot deck 36 and the cold deck 38. The pressure means 104 senses the back pressure in the hot deck 36 and the cold deck 38, caused by throttling, and produces an electrical output signal proportional to the average thereof with reference to the predetermined set point.

The volume control means 46 also includes a variable speed drive 110 responsive to the pressure means 104, or more particularly, the electrical output signal thereof. The variable speed drive 110 provides variable output speeds to the air mover 28 from the constant speed source, i.e., the motor 30. A suitable variable speed drive 110 is presently manufactured and sold by the Eaton Corporation, Cleveland, Ohio, as the Cleveland Speed Variator.

The variable speed drive 110 operatively controls the air mover 28 to maintain the static pressure within the HVAC unit 16 at substantially the predetermined set point. Problems of excessive back pressure, fan instability and noise are thereby substantially avoided.

Although the volume control means 46, as shown herein, includes the pressure means 104 and the variable speed drive 110, it is to be understood that other apparatus and methods of varying the output of the air mover 28 are available. For example, a frequency variable motor could be utilized, with the frequency of the drive signal being altered in response to an output signal of the control mechanism 20.

Converting the Gilles system to an improved VAV system, the present invention combines the respective advantages and provides a more efficient VAV air processing system. More particularly, the present invention provides heating and cooling without mixture of supply air streams (under certain conditions), heat reclaim and economizer operation.

Potential energy savings are illustrated in the following theoretical table, comparing the conventional Gilles system, a conventional VAV system (inlet vane) and the present invention. The table is based upon representative simultaneous conditions within a (5) zone building and an outside air temperature of approximately (30° F). The desired zone temperature is (73° F). It is assumed that zones 1, 2, 3, 4 and 5 require, with the conventional Gilles, (2000) cfm of supply air having respective temperatures of (60° F), (70° F), (80° F), (90° F) and (100° F).

TABLE 1

| | Conventional Gilles System | | Conventional VAV System | Present Invention | |
|---|---|---|---|---|---|
| ZONE | Hot Deck CFM | Cold Deck CFM | Single Deck CFM | Hot Deck CFM | Cold Deck CFM |
| 1 | | 2000 | 2000 | | 2000 |
| 2 | 500 | 1500 | 460 | | 460 |
| 3 | 1000 | 1000 | 400 | 520 | |
| 4 | 1500 | 500 | 400 | 1260 | |
| 5 | 2000 | | 400 | 2000 | |
| Total BTU/Hr. | 145,800 | | 122,688 | 110.225 | |

Reduced air flow further reduces energy consumption. That is, the air mover 28 is operated at a slower speed. Utilizing the volume control means 46 shown herein, motor energy savings are approximately the cube of the air reduction factor, e.g., 5% less air flow, 15% less energy. Combining processing and motor energy savings, theoretical studies predict potential savings of approximately thirty percent (30%) over the conventional VAV system.

The present invention also provides an adaptability to meet, in practical terms, all heating, cooling and ventilating requirements. In areas requiring maximum ventialtion, e.g., secretarials pools, the first predetermined position of the shaft 48 and the second predetermined position of the tube 54 are preferably set to coincide with the operational midpoint of the first damper element 52 and the second damper element 58, respectively. Conversely, in low density areas, such as a computer room, the first predetermined position and the second predetermined position are set to permit substantially complete closing of one deck prior to opening of the other. Adjustability of the drive means 84 further permits in-the-field modification of the present invention, such that conditional changes within a thermal zone 14 can be accommodated.

Those skilled in the art will recognize that the single embodiment described herein may be modified and altered without departing from the true spirit and scope of the invention as defined in the accompanying claims.

What is claimed is:

1. In an air processing system for conditioning air enclosure of the type including an air mover, thermostatic means for sensing the temperature of said enclosure, a first deck, a second deck and duct means for interconnecting said enclosure and said air mover, said duct means having a first passage and a second passage communicating with said first deck and said second deck, respectively, an improvement comprising, in combination:

a shaft rotatably mounted to said duct means, said shaft extending substantially through said first passage and said second passage and beyond said duct means to define a shaft control portion, said shaft including a shaft actuating arm secured to said shaft control portion;

a first damper element secured to said shaft within said first passage;

a tube rotatably mounted on said shaft, said tube extending substantially through said second passage and beyond said duct means to define a tube control portion, said tube including a tube actuating arm secured to said tube control portion;

a second damper element secured to said tube within said second passage;

stop means for detachably securing said shaft and said tube in a first shaft position and a first tube position, respectively;

drive means for driving said first damper element and said second damper element in response to said thermostatic means, said drive means including a shaft drive arm and a tube drive arm adapted to engage said shaft actuating arm and said tube actuating arm, respectively, said shaft, said tube and said drive means cooperatively defining attachment means for detachably securing said shaft actuating arm and said tube actuating arm to said shaft drive arm and said tube drive arm, respectively; and volume control means for variably operating said air mover in response to said first damper element and said second damper element;

said shaft and said tube being operable in a first mode wherein said shaft actuating arm is detachably secured to said shaft drive arm and said tube is detachably secured in said first tube position by said stop means, a second mode wherein said shaft actuating arm and said tube actuating arm are detachably secured to said shaft drive arm and said tube drive arm, respectively, and a third mode wherein said shaft is detachably secured in said first shaft position by said stop means and said tube actuating arm is detachably secured to said tube drive arm.

2. An improvement as claimed in claim 1 wherein said shaft is operable between said first shaft position and a second opposing shaft position, and said tube is operable between said first tube position and a second opposing tube position.

3. An improvement as claimed in claim 2 wherein said shaft and said tube are operable in said first mode whenever said shaft is between said second opposing shaft position and a first predetermined position between said first shaft position and said second opposing shaft position.

4. An improvement as claimed in claim 3 wherein said shaft and said tube are operable in said third mode whenever said tube is between said second opposing tube position and a second predetermined position between said first tube position and said second opposing tube position.

5. An improvement as claimed in claim 4 wherein said first damper element and said second damper element substantially close said first passage and said second passage, respectively, whenever said shaft and said tube are in said first shaft position and said first tube position, respectively.

6. An improvement as claimed in claim 1 wherein said attachment means includes a pair of first magnets.

7. An improvement as claimed in claim 6 wherein said first magnets are secured to said shaft drive arm and said tube drive arm.

8. An improvement as claimed in claim 1 further comprising a control deck adapted to receive said shaft and said tube.

9. An improvement as claimed in claim 8 wherein said stop means is mounted on said control deck.

10. An improvement as claimed in claim 9 wherein said stop means includes a pair of second magnets adapted to engage said shaft actuating arm and said tube actuating arm, respectively.

11. An improvement as claimed in claim 1 wherein said variator means includes pressure means for sensing the static pressure within said first deck and said second deck.

12. An improvement as claimed in claim 11 wherein said variator means further includes a variable speed control responsive to said pressure means and interconnected to said air mover.

* * * * *